US009366513B1

(12) United States Patent
Kendall

(10) Patent No.: US 9,366,513 B1
(45) **Date of Patent: *Jun. 14, 2016**

(54) INDICATOR FOR AN ARROW

(71) Applicant: Barnett Outdoors, LLC, Tarpon Springs, FL (US)

(72) Inventor: Larry Kendall, Camdenton, MO (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/818,746

(22) Filed: Aug. 5, 2015

Related U.S. Application Data

(63) Continuation of application No. 14/078,356, filed on Nov. 12, 2013, now Pat. No. 9,121,678.

(60) Provisional application No. 61/725,444, filed on Nov. 12, 2012.

(51) Int. Cl.
*F42B 6/04* (2006.01)
*F42B 12/36* (2006.01)

(52) U.S. Cl.
CPC ..... *F42B 12/362* (2013.01); *F42B 6/04* (2013.01)

(58) Field of Classification Search
CPC ..... F42B 6/04; F42B 6/06
See application file for complete search history.

(56) References Cited

U.S. PATENT DOCUMENTS

| | | | | |
|---|---|---|---|---|
| 6,641,493 | B1 | 11/2003 | Shifflett | |
| 7,775,919 | B2 | 8/2010 | Oswald et al. | |
| 9,121,678 | B1 * | 9/2015 | Kendall | F42B 12/362 |
| 2002/0028718 | A1 | 3/2002 | Coe | |

* cited by examiner

*Primary Examiner* — John Ricci
(74) *Attorney, Agent, or Firm* — Jones Walker LLP

(57) ABSTRACT

The various embodiments disclosed and pictured illustrate an indicator for determining if and/or where a projectile has struck a target. The illustrative embodiment pictured herein is specifically adapted for application to a shaft, such as a shaft of an arrow. The external surface of the indicator may be textured so as to retain a certain amount of liquid within the target upon striking the target. In one example, the indicator is configured for use with deer hunting such that the external texture of the indicator is configured to retain a specific amount of deer blood so that the hunter may determine, based on blood characteristics retained within the indicator, if and where the arrow to which the indicator is affixed struck the deer.

7 Claims, 5 Drawing Sheets

INDICATOR FOR AN ARROW

CROSS REFERENCE TO RELATED APPLICATIONS

This application is a continuation of and claims priority to U.S. patent application Ser. No. 14/078,356, filed on Nov. 12, 2013, now issued as U.S. Pat. No. 9,121,678, which claims the benefit of U.S. Provisional Patent Application No. 61/725,444, filed on Nov. 12, 2012, both of which are incorporated by reference herein in their entirety.

FIELD OF INVENTION

This invention relates generally to a device for indicating material on the outside of a shaft. More specifically, the invention is especially useful for an indicator positioned on an arrow.

BACKGROUND OF THE INVENTION

When using a bow and arrow to hunt various game, it may be difficult for the hunter to determine when/if the arrow has hit the target. Even when the hunter knows for certain he hit the target, it may be difficult for him to determine where he hit the target (e.g., chest, stomach, etc.).

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION OF THE INVENTION

Figure 1:
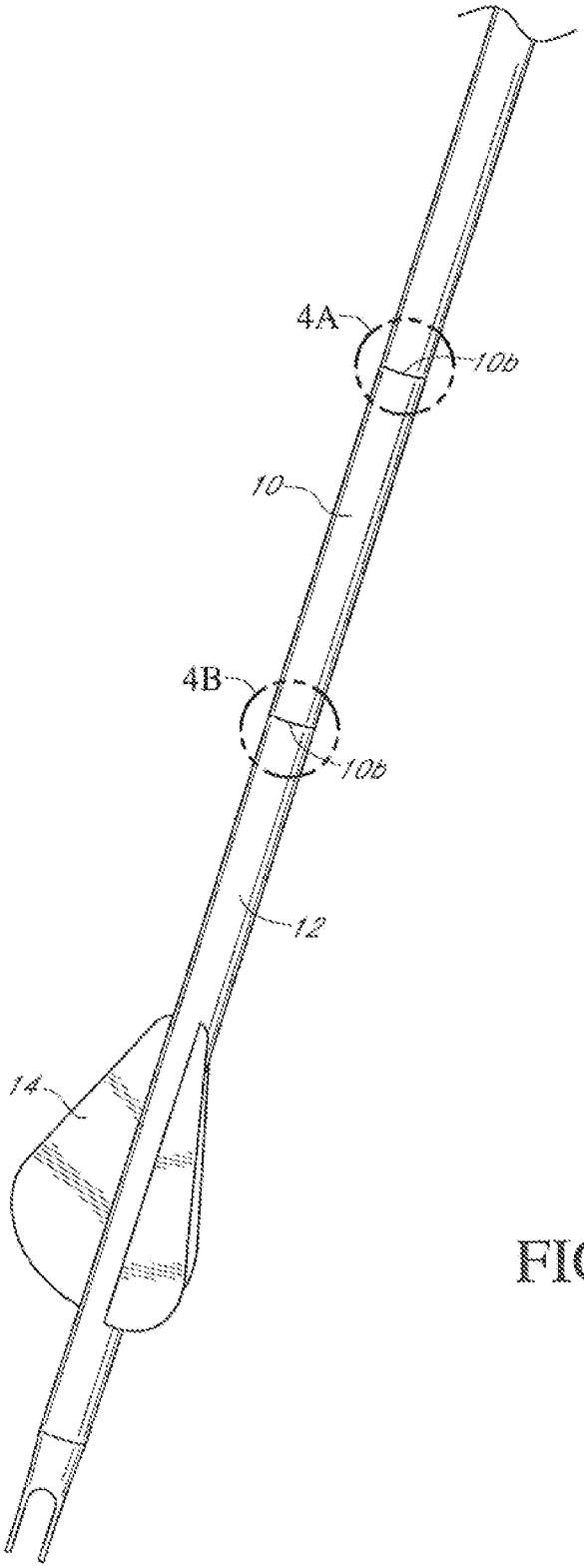
FIG. 1 provides a perspective view of an illustrative embodiment of an indicator affixed to a shaft prior to use.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 provides a perspective view of an illustrative embodiment of an indicator 10. The indicator may be affixed to a shaft 12 of an arrow as shown in FIG. 1. It is contemplated that the optimal placement for an indicator 10 may be at a position of the arrow's shaft 12 between the arrow head (not shown) and the guides 14. However, other placements of an indicator 10 along the length of the shaft 12 may be used without departing from the spirit and scope of the present disclosure.

The indicator 10 may be affixed to the shaft 12 in any suitable manner. In one embodiment the indicator 10 is delivered as a liquid to the arrows shaft 12 such that the liquid dries in a specified period of time and the indicator 10 remains as a solid material affixed to the shaft 12, such as a paint or epoxy. In such an embodiment of an indicator 10, the paint, epoxy, or other material comprising the indicator 10 may have a predetermined texture to ensure the indicator 10 adequately performs its function for a given application. Alternatively, the indicator 10 may be affixed to the shaft 12 as a solid material, such as a label that may be self-adhesive or a label to which adhesive may be applied. In some embodiments, the indicator 10 may be applied to the shaft 12 using a screen-printing process, such as a silk-screen process and the like. However, the scope of the present disclosure is not limited by the structure and/or method used to affix the indicator 10 to the shaft 12. Additionally, the optimal length along the shaft 12 that the indicator 10 extends will vary from one embodiment of the indicator 10 to the next, and is therefore in no way limiting to the scope of the present disclosure.

It is contemplated that the exterior surface of the indicator 10 may be textured so as to retain a specific amount of liquid material once the liquid material comes in contact with the indicator 10. The specific configuration of the texture for the indicator 10 (e.g., pattern, coarseness, granularity, etc.) will vary from one embodiment of the indicator 10 to the next, and is therefore in no way limiting. In one embodiment, the texture on the indicator 10 is comprised of a plurality of first surfaces and a plurality of second surfaces, wherein the height difference between the first surfaces and second surfaces is between 0.1 microns and 10 millimeters. In another embodiment of the indicator 10, the texture on the indicator 10 is comprised of a plurality of surfaces having different heights with respect to an adjacent surface, and the difference in height between adjacent surfaces may be between 0.1 microns and 10 millimeters. Such an embodiment may allow a single indicator 10 to retain more than one type of fluid. In still another embodiment, the indicator 10 may be comprised of various zones, wherein the texture of each zone may have surfaces with height variances within different ranges. For example, a first zone may have surfaces with height differences within the range of 10 microns to 100 microns, and a second zone may have surfaces with height differences within the range of 0.1 microns and 10 microns.

Generally, it is contemplated that the texture of the indicator 10 will be configured to retain blood. Furthermore, it is contemplated that such configuration will be adequate to retain enough liquid so as to provide the user with the desired information related to the liquid. For example, if the indicator 10 is affixed to an shaft 12 used for hunting deer, the indicator 10 may be configured to provide the user with enough liquid (which liquid may be blood in this example) such that the user may identify whether the indicator 10 (and consequently the shaft 12) passed through the deer. That is, the indicator 10 may alert the hunter as to whether he hit the deer with the arrow to which the indicator 10 is affixed. However, because the optimal configuration of the texture of the indicator 10 will vary from one application of the indicator 10 to the next, the specific texture, pattern, height differences between surfaces, etc. of the indicator 10 in no way limits the scope of the present disclosure.

It is contemplated that some embodiments of the indicator 10 may be formed of a porous material, or have a portion thereon that is comprised of porous material. Such a configuration may assist users in determining if and/or where an arrow to which the indicator 10 is attached struck a target. The porous material may be constructed of a synthetic material, or it may be constructed of a natural material.

Figure 2A:
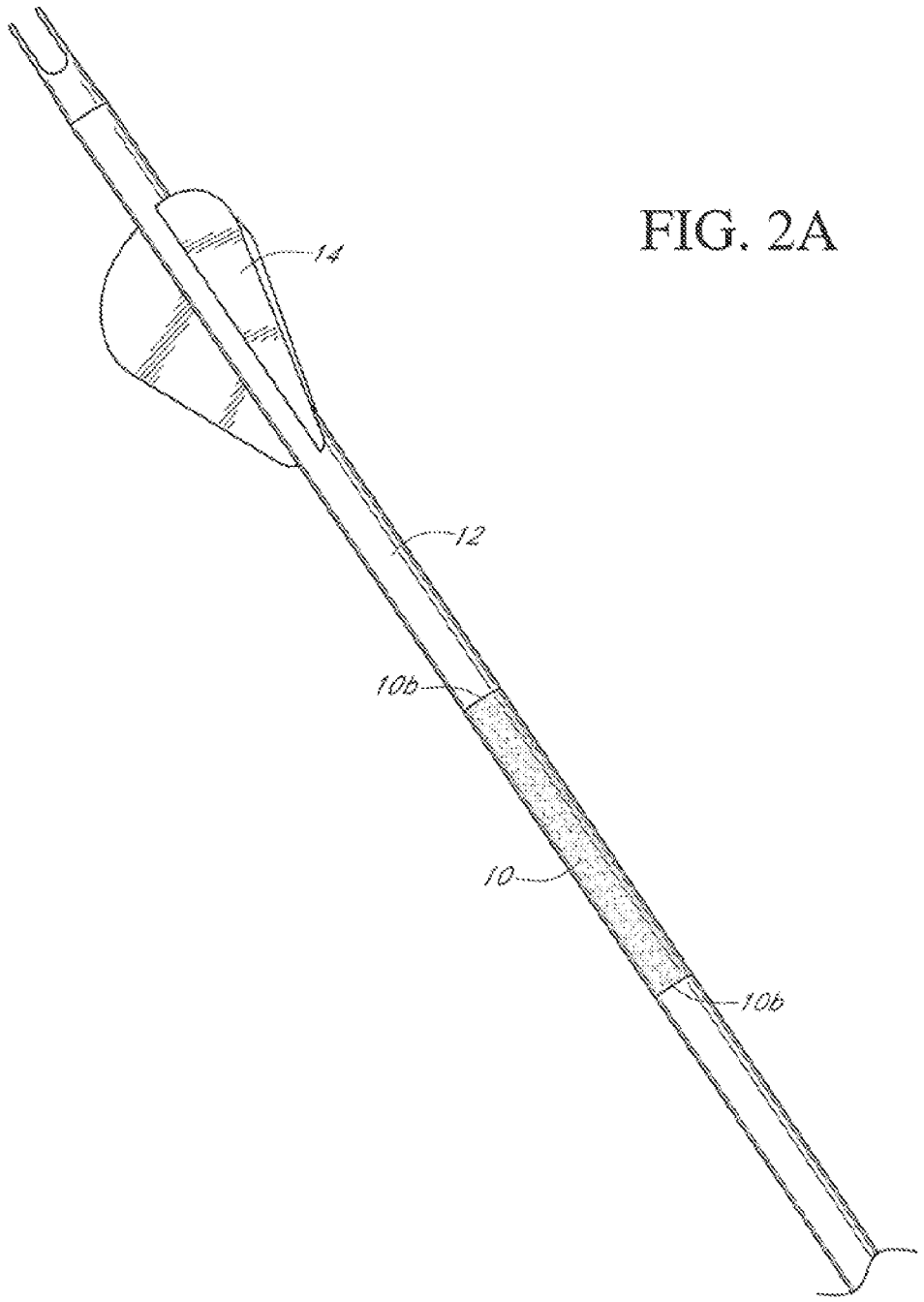
FIG. 2A provides a detailed perspective view of a first illustrative embodiment of an indicator that has contacted a target.

FIG. 2A provides a detailed perspective view of the first illustrative embodiment of an indicator 10 after the arrow to which the indicator 10 is affixed has hit a target. In this example, the target is wild game, such as a deer. As may be seen from FIG. 2A, the indicator 10 may serve to retain a certain amount of blood so that the hunter may determine whether he hit the target, and if so, in what area he hit the target. It is contemplated that the indicator 10 may be constructed of a material that is compatible with water and/or most aqueous solutions but insoluble thereto such that liquid retained in the indicator 10 may be removed using water and/or soap and water.

The illustrative embodiment of the indicator 10 may be white in color so as to better show retained liquid (provided the retained liquid is not white). In other embodiments the indicator 10 is differently colored. Accordingly, the color of the indicator 10 is in no way limiting to the scope thereof.

Figure 2B:
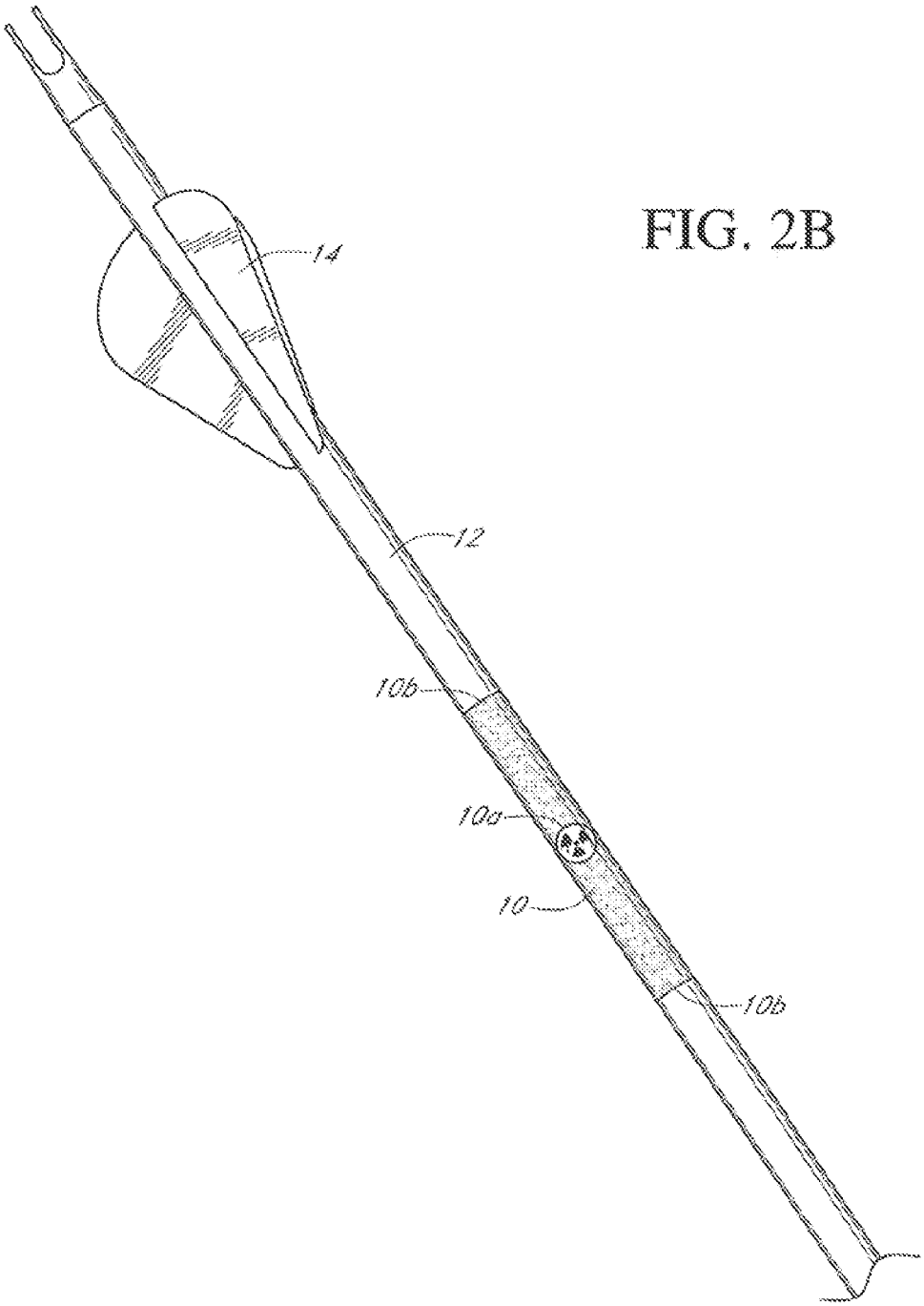
FIG. 2B provides a detailed perspective view of a second illustrative embodiment of an indicator that has contacted a target.

As previously mentioned, the indicator 10 may be configured such that the hunter may determine through what general area of the animal the arrow passed based on the characteristics of the fluid retained on the indicator 10. It is contemplated that the texture of the indicator 10 may be configured to display logos or other images after the indicator 10 has contacted the liquid it is designed to retain. Such an embodiment is shown in FIG. 2B, wherein a logo 10*a* has been formed in the indicator 10. The logo 10*a* may be configured with a texture that does not retain any liquid, thereby potentially increasing the contrast between the portion of the indicator 10 that does retain liquid and the shaft 12. This may assist the user in determining whether the arrow to which the indicator 10 is affixed has hit the target, and if so, in what area.

Figure 3:
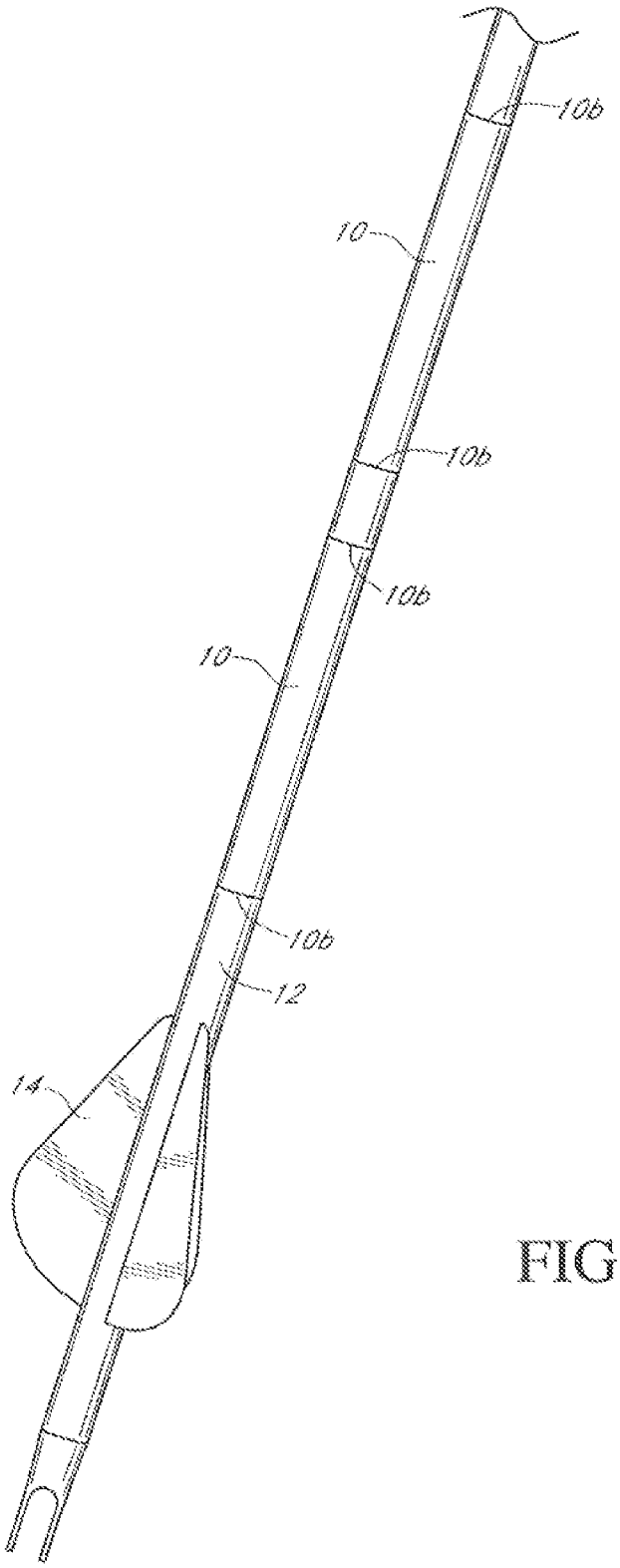
FIG. 3 provides a perspective view of an illustrative embodiment of a plurality of indicators affixed to a shaft prior to use.

In the pictured embodiment, the indicator 10 is configured to have a rectangular shape. However, other embodiments may be configured differently. In another embodiment, the indicator 10 may comprise one or more stripes separated from one another by areas of shaft 12. Such an embodiment may have multiple indicators 10 affixed to a single shaft 12 as shown for the embodiment pictured in FIG. 3. In still other embodiments the indicator 10 may be configured as a specific shape, such as a triangle, oval, animal silhouette, etc. In some of these embodiments, the indicator 10 may not fully encompass the circumference of the shaft 12. For example one embodiment not pictured herein, the indicator 10 may comprise multiple strips oriented parallel to the longitudinal axis of the shaft 12 and circumferentially spaced about the shaft 12. Accordingly, the shape of the indicator 10 as well as the number thereof will vary from one embodiment to the next, and is therefore in no way limiting to the scope of the present disclosure.

Figure 4A:
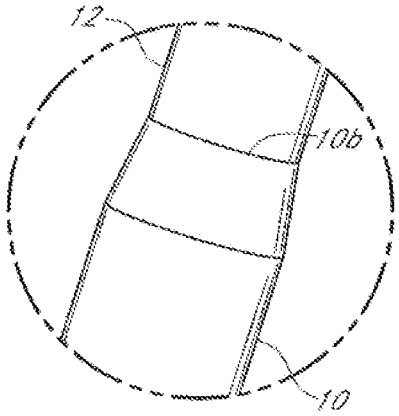
FIG. 4A provides a detailed view of an illustrative edge of an indicator that is configured to minimize an aerodynamic impact of the indicator.
Figure 4B:
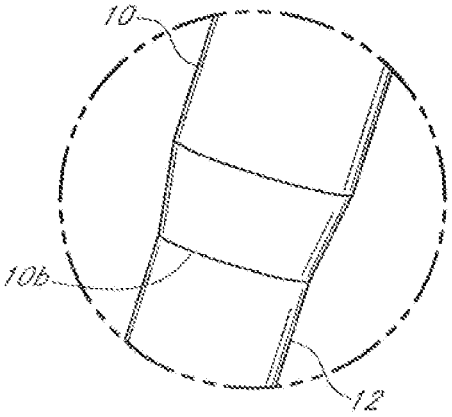
FIG. 4B provides another detailed view of an illustrative edge of an indicator that is configured to minimize an aerodynamic impact of the indicator.

It is contemplated that regardless of the material used to construct the indicator 10 (e.g., self-adhesive label, spray-on polymer, etc.) or the method of application of the indicator 10 on the shaft 12, the mass distribution of the indicator 10 around the periphery of the shaft 12 may be uniform so as to not affect the balance or other mechanical properties of the arrow to which the indicator 10 is affixed. Additionally, it is contemplated that the edges 10*b* of the indicator 10 may be configured to minimize the aerodynamic impact of the indicator 10 during flight of the arrow to which it is affixed. In certain embodiments, this may require forming a small ramp one or more edges 10*b* of the indicator 10, as shown in the embodiment pictured in FIGS. 4A and 4B.

Other methods of using the indicator 10 and embodiments thereof will become apparent to those skilled in the art in light of the present disclosure. Accordingly, the methods and embodiments pictured and described herein are for illustrative purposes only. The indicator 10 may also be mounted to structures other than shafts 12, (e.g., guide 14) and therefore the specific structure to which the indicator 10 is mounted is in no way limits the scope of the present disclosure.

The indicator 10 and various elements thereof may be constructed of any suitable material known to those skilled in the art. In the illustrative embodiment as pictured herein the indicator 10 may be constructed of polymers or other synthetic materials, metals or metallic alloys, cellulosic materials, wood or other natural materials, and/or combinations thereof. Furthermore, the indicator 10 may be constructed via casting, molding, extrusion, aerosol spray-on, or fabricated by any other manner that is appropriate for the specific materials of construction used.

It should be noted that the indicator 10 is not limited to the specific embodiments pictured and described herein, but is intended to apply to all similar apparatuses and methods for determining if and where a projectile has struck a target. Modifications and alterations from the described embodiments will occur to those skilled in the art without departure from the spirit and scope of the present disclosure.

What is claimed is:

1. A method of determining whether an arrow has contacted an animal, comprising the steps of:

a) shooting an arrow towards an animal, the arrow comprising: a shaft substantially cylindrical in shape; a guide affixed to the shaft at a first end thereof; an indicator affixed to the shaft between the first end thereof and a second end thereof, wherein the indicator is constructed of a material different than an exterior surface of the shaft and different than a material of the guide; wherein a texture of an exterior surface of the indicator is sufficiently rough to entrap a portion of fluid inside the animal;

b) retrieving the arrow;

c) inspecting the indicator for presence of the fluid; and d) determining if the arrow contacted the animal via presence of the fluid.

2. The method according to claim 1 wherein the indicator is further defined as extending around the entire periphery of the shaft along a predetermined length of the shaft.

3. The method according to claim 1 wherein the texture of the exterior surface of the indicator is further defined as having an image formed therein.

4. The method according to claim 3 wherein the image is cut into the indicator such that an exterior surface of the shaft is visible in the image.

5. The method according to claim 1 wherein the indicator is further defined as having a leading edge and a trailing edge.

6. The method according to claim 5 wherein the leading edge is further defined as being ramped.

7. The method according to claim 6 wherein the trailing edge is further defined as being ramped.

* * * * *